United States Patent [19]

King

[11] 3,939,981

[45] Feb. 24, 1976

[54] NESTING BASKET

[75] Inventor: Clarence J. King, Ludington, Mich.

[73] Assignee: Straits Steel & Wire Co., Ludington, Mich.

[22] Filed: July 10, 1974

[21] Appl. No.: 487,048

[52] U.S. Cl. ..... 206/507; 206/513; 220/19

[51] Int. Cl.[2] ..... B65D 7/20; B65D 21/04

[58] Field of Search ..... 206/507, 513; 220/19; 211/126, 181

[56] References Cited

UNITED STATES PATENTS

| | | | |
|---|---|---|---|
| 2,252,964 | 8/1941 | Faulkner | 206/513 |
| 2,813,656 | 11/1957 | Anderson | 206/507 |
| 3,160,308 | 12/1964 | Hare | 220/19 |
| 3,270,913 | 9/1966 | Bridenstine | 206/507 |
| 3,366,264 | 1/1968 | Panknin | 220/19 |
| 3,486,633 | 12/1969 | Wilson | 211/181 |

FOREIGN PATENTS OR APPLICATIONS

| | | | |
|---|---|---|---|
| 901,817 | 7/1962 | United Kingdom | 206/507 |

*Primary Examiner*—George E. Lowrance
*Attorney, Agent, or Firm*—Price, Heneveld, Huizenga & Cooper

[57] ABSTRACT

A container of wire construction for transport and storage of articles is disclosed. The container has top and bottom rims and a wire grid forming the bottom. Wires also form side structures. The wires forming the sides are welded to the inner face of the top rim and the outer face of the bottom rim providing the container with only slightly inclined end and side walls. The wires forming the end and side walls are inclined toward one side or end, respectively, whereby the containers can be nested with minimal vertical offset. The ends of the rims are provided with spaced pairs of inwardly extending loops which permit the containers to be stacked in interlocking relationship without vertical telescoping.

1 Claim, 8 Drawing Figures

NESTING BASKET

FIELD OF THE INVENTION

This invention relates to nestable and stackable containers for the transport and storage of articles. The containers are fabricated of thin, spaced members such as wire or red and have upper and lower rim elements defining the top and bottom of the container. Containers of this general construction, which are both nestable and stackable, are well-known. However, containers of this type have a number of limitations which are eliminated by this invention.

Conventional containers of this type, when nested for compact storage, only partially telescope one into the other, thus wasting substantial space because in any given vertical column only a limited number of the containers can be nested. Another limitation has been that the containers when stacked are so designed that there is a significant amount of vertical telescoping of the upper container into the container below. This materially reduces the storage capacity of the containers. In prior art containers of this type, where deep nesting was possible, the stops or supports which made possible the stacking of the containers are turned outwardly from the container. This creates problems in that it prevents close side-by side arrangement of the containers which is not only a waste of space but, under circumstances such as shipment in freight cars or trucks, the containers cannot be sufficiently closely packed to assure one stack acting as a lateral support for an adjacent stack. Also, the accidental interengagement of such projections of one stack of containers with those of another creates a potential hazard during handling of the containers.

BRIEF DESCRIPTION OF THE INVENTION

The invention provides a container of almost square configuration having an upper rim element and a lower rim element. The bottom of the container is formed by an intersecting grid of wires which are secured to the lower rim element. The sides and ends of the container are formed of upstanding wires. These wires are arranged in slightly outwardly and upwardly inclined vertical planes with the wires in the sides being inclined toward an end of the container and the wires in the ends being inclined toward a side of the container. The tops of the wires forming the sides and ends of the container are secured to the inside surface of the upper rim and to the outside surface of the lower rim whereby the containers may be nested one within the other with the wires of one container at least at one of the sides or the ends seated against the wires of the other container and the wires of both containers being in a common vertical plane.

The containers also have, at each of their ends, inwardly extending loops formed in the upper rim and are aligned with larger, inwardly extending loops in the lower rim. The size of the loops in the lower rim is such that the loops in the upper rim will pass through the loops of the lower rim. The depth of the loops in the upper rim is such that when one container is rotated 90° with respect to another container, it can be stacked upon the container beneath with the loops in the upper rim of the lower container providing support for the container above. Stops are provided on the loops in the upper rim to positively index the upper container with respect to the lower container.

DETAILED DESCRIPTION OF THE DRAWINGS

DESCRIPTION OF THE PREFERRED EMBODIMENT

Figure 1:
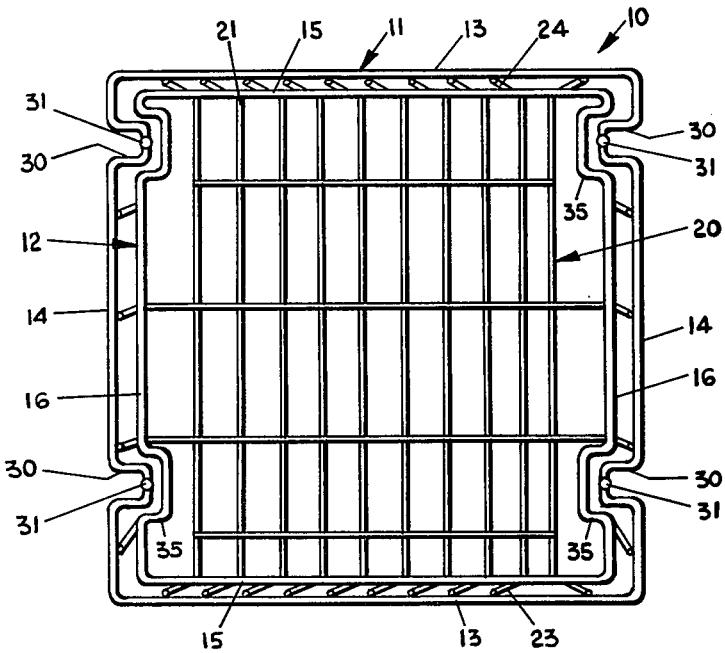
FIG. 1 is a plan view of a container embodying this invention.

Referring specifically to FIG. 1, the numeral 10 refers to a container having an upper rim 11 and a lower rim 12. As illustrated, the rims 11 and 12 are endless and entirely encompass the container. While the rings could be of any acceptable material, a preferable material is steel wire or small diameter rod. The upper rim has a pair of sides 13 and a pair of ends 14. The lower or bottom rim has a pair of sides 15 and a pair of ends 16. For the purpose of this invention, the lower portion of the container can be made without an endless lower rim. It need only have the sides 15 since the ends 16 could be eliminated. This would significantly reduce the strength of the container but it would not change its functional principles.

Figure 4:
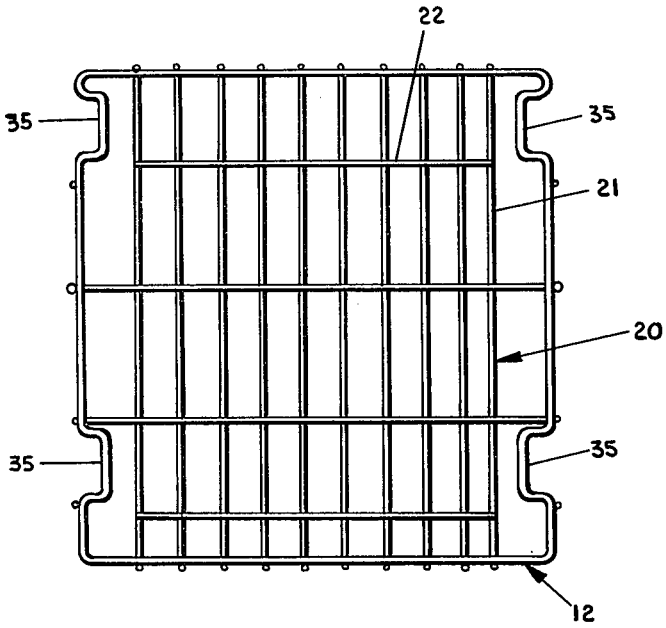
FIG. 4 is a sectional view taken along the plane IV—IV of FIG. 2.
Figure 2:
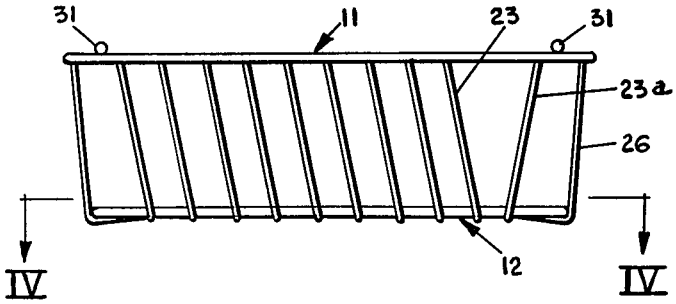
FIG. 2 is a side elevation view of the container shown in FIG. 1.

As is clearly seen in FIG. 1, the area encompassed by the lower rim 12 is less than the area encompassed by the upper rim 11. However, the difference in area is small since the sides are almost vertical. The bottom 20 of the container is formed by an intersecting grid of wires with one group of parallel wires 21 extending between the sides and a second group of parallel wires 22 extending at right angles thereto (FIG. 4). Where the wires 21 and 22 intersect, they are suitably attached as by welding. In the preferred embodiment of the invention, the wires 21 extending between the sides extend beyond the sides of the bottom 20 and wrap about the lower rim 12 and are bent upwardly to form the upstanding side members 23 and 24. When the wires 21 pass around the exterior of the rim 12 and become the upstanding side members 23, the wires are rigidly secured to the rim member by suitable means such as welding. The upper ends of the side members 23 and 24 are rigidly attached to the inside face of the upper rim member 11. Thus, it will be observed that the wires pass about the outside of the lower rim member and are on the inside of the upper rim member. This arrangement is important in permitting maximum depth of telescopic nesting of the containers when they are nested for storage. It will be observed in FIG. 2 that all, except one, of the upstanding side members 23 are parallel and are inclined toward one end of the container. This inclination is in the range of 5 to 10 degrees and is provided to facilitate nesting. It will be noted that one of the upstanding side members **23*a*** is inclined in the opposite direction at approximately the same angle. This arrangement of this particular side member is to reduce the width of the gap at the top rim which would otherwise result from the inclination of the side members.

Figure 3:
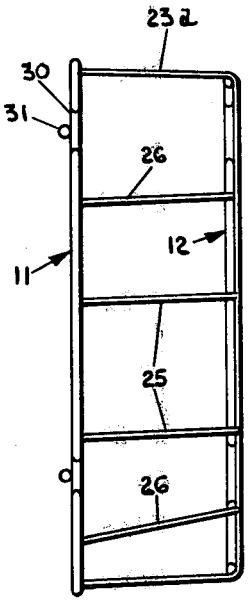
FIG. 3 is an end elevation view of the container shown in FIG. 1.

Some of the wires 22 extending between the ends of the container are also formed with their ends bent into upstanding end members 25 as seen in FIG. 3. Other upstanding end members 26 are formed from short pieces which extend from the lower rim to the upper rim. Again, the lower ends of the upstanding end members 25 and 26 are welded to the outer surface of the bottom rim and are welded to the inner surface of the top rim. Again, the upstanding end members 25 and 26 are inclined toward one side to facilitate nesting.

Figure 8:
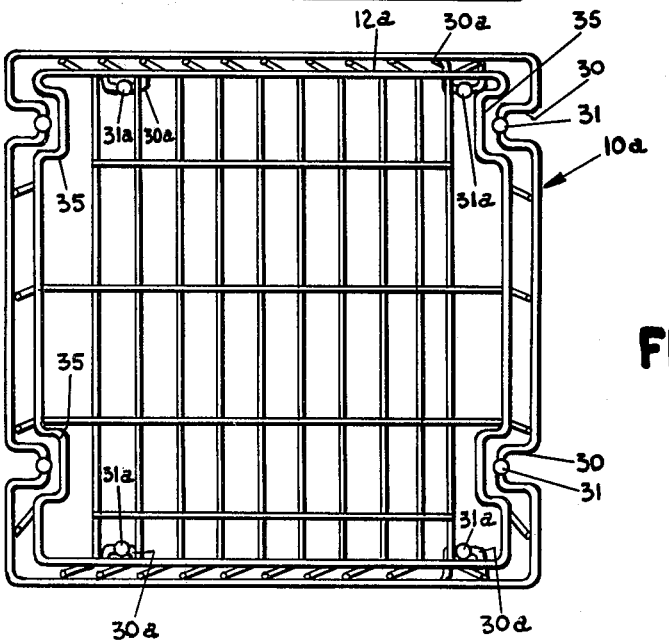
FIG. 8 is a plan view of the stacked containers illustrated in FIG. 7 but showing only the supporting loops of the lower one of the containers.

Each of the ends of the upper rim 11 has a pair of spaced, inwardly extending loops 30. These loops are adjacent the sides but spaced a short distance inwardly from the sides. It will be noted that the loops adjacent one side of the container are spaced further from the side of the container than the corresponding loops at the other side. At the inner end of each of the loops an upstanding stop 31 is mounted to the top of the upper rim. This stop can be of any suitable configuration but preferably is generally spherical so that it will present rounded edges which will not damage other containers or the contents of other containers. The depth of the loops 30 is such that the lower rim 12 of a superimposed container will seat over the stops 31 of a container beneath when the superimposed container is rotated 90° to the container below. The preferred construction is such that the stops 31 will just fit between the sides of the lower rim of the upper container. This condition is illustrated in FIG. 8 wherein only the loops 30*a* and the stops 31*a* of the lower container are illustrated to avoid confusion of lines in the drawing. It will be seen that in this case the upper or superimposed container 10*a* has been rotated 90° to the container beneath and thus the sides of its lower rim 12*a* are now parallel to the ends of the container beneath. By this arrangement, one container can be stacked upon another with the stops providing a positive index from one container to another, with the loops providing four points of support for the container above.

Figure 7:
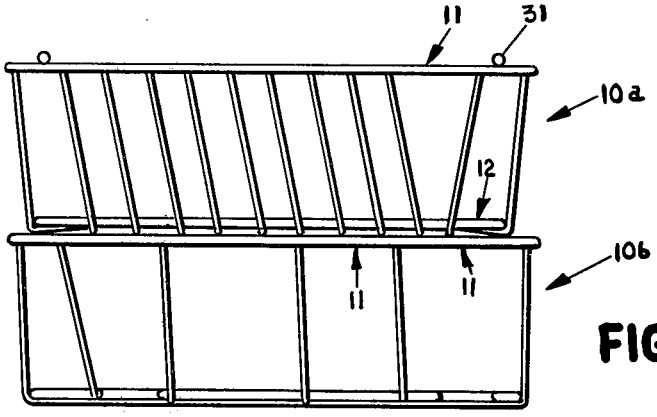
FIG. 7 is a side elevation view of a pair of the containers shown in stacked relationship.

Since the lower rim 12*a* of the upper container rests on top of the upper rim 11*a* of the container below (see FIG. 7) the containers, when stacked, do not telescope one into another, thus the entire volume of the container may be used for storage. This eliminates loss of capacity efficiency of the containers when they are stacked. This is clearly illustrated in FIG. 7 where the container 10*a* is shown resting on top of the container 10*b*. With this arrangement a large number of containers can be stacked vertically without loss of storage volume and because the points of support are basically at the four corners of the container and the containers are both indexed and held against significant sliding movement one with relation to the other, a particularly stable and efficient storage facility is provided by this invention.

To permit the containers to nest, the lower rim 12 is also provided with loops 35 which are aligned with the loops 30 in the upper rim and are of a size and shape such that they readily allow the loops of the upper rim to pass through them. In this manner, the loops 30 of the upper rim of a lower container will pass up through the loops 35 of an upper container as the containers are telescoped together for nested storage. The differential in spacing of the loops from the sides positively indexes the containers so that they can only be stacked in a particular orientation one to the other since this renders the containers asymetrical about their centerline.

Figure 5:
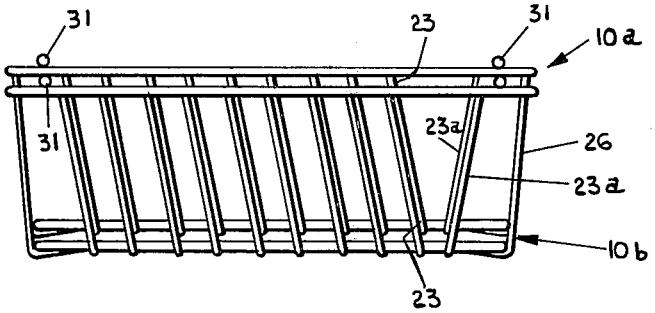
FIG. 5 is a side elevation view of a pair of the containers shown in nested position.
Figure 6:
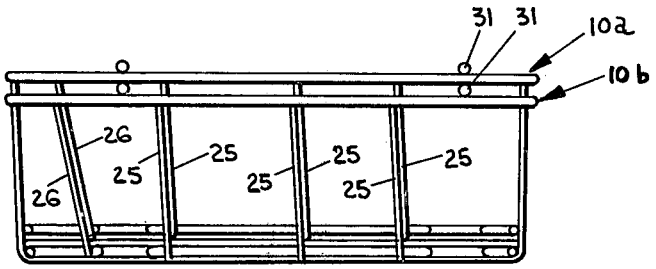
FIG. 6 is an end elevation view of the same nested containers as shown in FIG. 5.

When the containers are not being used, they can be compactly stored by nesting one within another. The relation ship of the containers as so nested is illustrated in FIGS. 5 and 6. Because of the inclination of the upstanding side members 23 and 23*a*, it will be noted that as the containers are nested, the inclined side members 23 of the container above will seat against and lie in side-by-side relationship to the inclined side members of the container beneath. As will be observed in FIG. 6, the same relationship of the upstanding end members 25 and 26 occurs.

This side-by-side relationship of the side members 23 is important. It eliminates the necessity of making provision for the thickness of these members when the containers are nested as would occur if these members had no inside-outside relationship. This arrangement allows deeper and, therefore, more compact nesting. It also reduces the degree of slope or inclination which must be given the sides and ends which, in turn, makes the containers more efficient as storage units. This is particularly true when their efficiency is assessed on the basis of occupied floor space.

Because the sides and the ends of the containers have a slight outward taper, actual contact between the upstanding side members and the upstanding end members of two containers will not occur until the containers are substantially totally nested. The slight inclination or draft of the sides and ends of the containers plus the inclination of the side members and end members within the respective planes of the sides and the ends permits the containers to telescope together to such a degree that the upper rim of the upper container A will rest upon the tops of the stops 31 of the lower container as is illustrated in FIGS. 5 and 6. Thus, depending upon the tolerances of manufacture, even when the containers are fully nested, there may actually be no contact between the inclined side members 23 or the inclined end members 25 and 26 of the containers. This is important because it eliminates the jamming which so often occurs with nested containers and results in not only frustration for the operators, but considerable loss of time efficiency in both stacking and unstacking the containers. It also materially reduces wear on the containers as they are nested and unnested. This is especially desirable in the case of plated containers such as are used in the food industry or with products which might be damaged by rust or similar marking. Further, since the containers when nested rest on four indexed points, those being the stops of the containers beneath, the containers when nested are parallel one to another creating a truly vertical column which is stable and compact. The ability to store the containers in tall, stable, erect columns gives the containers a maximum of efficiency in the use of storage space. This is important in considering the efficiency of the container over its service life since storage space is both expensive and often limited. This is particularly true when containers of this type are being returned to their point of origin from their point of unloading, such as occurs when goods are shipped in containers of this type and must be returned by rail, air or truck. Also, the fact that these containers will compactly nest in accurately indexed columns makes them stable during such shipment, reducing damage and wear.

The construction of this container permits it to be almost square. It also permits the container to be designed with minimal draft or slope on the sides. Thus, the container is efficient as to the quantity of product which may be stored within it in relation to the square footage of floor space it occupies both when in storage and when in transport. The same is true with respect to the containers when they are nested and in storage. The use of the inwardly turned ears for stacking the containers also contributes materially to their efficiency since it permits one stack of containers whether stacked or nested, to be positioned immediately against the next stack without wasted space between them. This also assures positive support of one stack for another which is important both during storage and during transport. It is particularly important in transport because it permits close pack between the vertical columns of containers thereby allowing them to be strapped or otherwise locked in position in such a manner that they cannot shift with respect to each other under the type of conditions incident to transport by air, rail or truck. The containers also are efficient in the use of space where they are utilized with rack storage. Since the cost of transport and of storage space is expensive, this is an important efficiency.

While a preferred embodiment of the invention has been described, it will be recognized that various modifications of the invention can be made without departing from the principles of the invention.

The embodiments of the invention in which an exclusive property or privilege is claimed are defined as follows:

1. A nestable-stackable container for the transport and storage of articles, said container having spaced endless upper and lower rim elements, said lower rim element enclosing a smaller area than said upper rim element, first and second spaced members arranged in an intersecting pattern to form a grid, said grid forming the bottom thereof and being secured to said lower rim element, first upstanding spaced members forming the sides of said container and second upstanding spaced members forming the ends of said container, said container characterized in that said upper and lower rim elements at each of their ends have a pair of inwardly offset portions, said inwardly offset portions on opposite ends being spaced equally from both sides of said container; the sides of said upper and lower rim elements being straight; the spacing between the sides of said lower rim element whereby the lower rim element of an upper container will rest upon the inner ends of the offset portions of the upper rim element of a lower container when one container is rotated 90° with respect to and stacked upon the other thereof; the exteriorly facing opening formed by each of the offset portions in said lower rim being of a size to permit the offset portion in the upper rim to pass vertically therethrough when the containers are nested; upstanding stops on the top of said offset portions of said upper rim element, said stops being so spaced as to engage the inner face of the lower rim element of the upper of the stacked containers; the vertical height of said stops being no greater than the vertical thickness of said bottom whereby no portion of said stops will project into the interior of the upper of the containers when said containers are stacked and the stops of the container beneath support the container above by contact with the lower face of the upper rim of the upper of the containers when said containers are nested.

* * * * *